US005494594A

United States Patent [19]

Rodzewich

[11] Patent Number: 5,494,594

[45] Date of Patent: Feb. 27, 1996

[54] METAL SURFACE TREATMENTS

[75] Inventor: Edward A. Rodzewich, Flourtown, Pa.

[73] Assignee: Betz Laboratories, Inc., Trevose, Pa.

[21] Appl. No.: 282,127

[22] Filed: Jul. 28, 1994

Related U.S. Application Data

[63] Continuation-in-part of Ser. No. 106,502, Aug. 13, 1993, abandoned.

[51] Int. Cl.[6] ..... C10M 173/02

[52] U.S. Cl. ..... 252/49.3; 252/41; 252/49.8; 252/51.5 R; 252/156; 134/2; 134/40

[58] Field of Search ..... 252/49.3

[56] References Cited

U.S. PATENT DOCUMENTS 4,925,582 5/1990 Bennett ..... 252/49.3

*Primary Examiner*—Ellen M. McAvoy

*Attorney, Agent, or Firm*—Alexander D. Ricci; Richard A. Paikoff

[57] ABSTRACT

A method and composition for reducing and maintaining the coefficient of friction of a metal surface cleaned by an alkaline cleaner, while preventing the formation of foam on said surface, is disclosed. The cleaned metal surface is contacted with a treatment comprising monoethanolamine, an ethoxylated alkyl ether phosphate and a silicate.

8 Claims, No Drawings

METAL SURFACE TREATMENTS

This is a continuation-in-part of application Ser. No. 08/106,502 filed Aug. 13, 1993, now abandoned.

FIELD OF THE INVENTION

The present invention relates to the cleaning of metal surfaces with aqueous alkaline cleaners. More particularly, the present invention relates to additives to aqueous metal cleaning solutions which lower the coefficient of friction of cleaned metal surfaces, while preventing the formation of foam on said surfaces.

FIELD OF THE INVENTION

Single stage cleaning of metal surfaces with aqueous cleaning solutions is known. The cleaning solutions remove coolants and lubricants employed in machining operations. Metal fines and other contaminants from metal forming and machining operations are also removed by the cleaning process. Conventional cleaners frequently result in a surface finish which is susceptible to oxidation and/or an increased coefficient of friction over time. For metal articles which are machined to close tolerances, such surface degradation can have a deleterious effect on later operations, such as automated assembly operations.

In assembly operations by automated equipment, such surface degradation, i.e., high coefficient of friction, may cause jamming or require decreased operating speeds for the equipment. High coefficients of friction may also cause automated assembly equipment to reject an excessive number of parts. An excessively thick oxide layer may actually prevent entry of a part into an automated machining process.

The use of automated machinery and assembly equipment is common, for example in the production of automotive engines and transmissions. A need exists in the metal treatment industry for cost effective, simple means to modify the coefficient of friction of machined articles and inhibit oxide growth in order to improve their assembly properties. A reduction in the coefficient of friction and the maintenance of a low coefficient of friction over time will improve the ease of assembly for articles machined to close mechanical tolerances.

Those practiced in the art know that the coefficient of static friction between two surfaces is almost always larger than the coefficient of kinetic friction. A high coefficient of static friction is generally a limiting factor in assembly operation speed. A reduction in the coefficient of static friction will improve, by decreasing, the rejection rate of parts by automatic assembly equipment. This will allow more efficient production. It also may be possible to increase the speed of the assembly operation.

It is therefore desirable to improve, by decreasing, the coefficient of friction of machined metal articles which are cleaned by an aqueous alkaline cleaner. It is an object of the present invention to improve the coefficient of friction of machined metal articles which are cleaned by aqueous cleaners.

Lubricity-imparting additives are known in the aluminum beverage container industry. (See, for example, U.S. Pat. No. 4,859,351, Awad and 5,061,389, Reichgott). The additives described in the prior art are preferably applied after cleaning and rinsing of the aluminum. The additives described in the prior art may be inappropriate in single-stage cleaning solutions for several reasons. The prior art additives, such as ethoxylated fatty acids and polyethylene glycol esters may not resist alkaline hydrolysis in an alkaline cleaner concentrate or cleaner bath. The delay between cleaning and subsequent machining steps in the present invention may be several weeks, whereas the delays between cleaning and printing steps for beverage containers is typically on the order of minutes.

The requirements of a single stage cleaning process are substantially different than other metal cleaning operations. Only a single pH may be used. Intermediate rinses are not available to remove soils and metallic fines. The cleaning solution must drain efficiently from the cleaned surface. Also, the growth of oxide layers on the metal surface must be controlled after oils have been removed by the cleaner. The current use of chlorinated solvents to accomplish these goals is under increasing pressure from both health and environmental regulation.

U.S. Pat. No. 4,578,208 (Geke et al.) relates to the cleaning and passivating of metals using a treatment containing an alkanolamine, at least one non-ionic surfactant, and a phosphate ester. This particular combination does not provide lubricity, and discolors aluminum surfaces. Furthermore, the use of a nonionic surfactant for cleaning purposes produces excessive foam in deionized or soft water at ambient conditions.

SUMMARY OF THE INVENTION

The present invention provides an additive for a single stage aqueous cleaning composition for metal surfaces which imparts improved lubricity to the metal surfaces being treated. By improved lubricity, it is meant that the coefficient of friction for the cleaned metal surface is decreased and shows a tendency to stay low over time.

The additive of the present invention comprises monoethanolamine, a phosphate compound and a silicate. The monoethanolamine serves to protect steel or ferrous surfaces from rusting, and the phosphate compound, preferably an ethoxylated alkyl ether phosphate, provides lubricity to the cleaned parts. The silicate serves to prevent the discoloration, darkening and etching of the metal surface, e.g., aluminum, brass or copper during cleaning. The treatment will operate effectively at ambient conditions for cleaning mixed metal systems (aluminum, steel, etc.). Under these conditions, the treatment will impart a film on the metal part which prevents oxide buildup, and thereby maintains a low coefficient of friction.

DETAILED DESCRIPTION OF THE INVENTION

The combination of monoethanolamine, a phosphate compound and a silicate was found to impart improved lubricity to metallic surfaces. The phosphate compound is preferably an ethoxylated alkyl ether phosphate, e.g., a polyoxyethylene octadecenyl ether phosphate, available as Lubrhophos® LB400 by Rhone Poulenc, Inc. This compound provides the lubricity, as well as the surfactant properties of the cleaner. It is this material which allows for enhanced cleaning efficiency for aluminum and steel surfaces, with no foaming. The combination will also provide corrosion resistance to steel surfaces.

The combination of the present invention provides enhanced passivation of metal surfaces compared to prior art treatment approaches. The present invention is especially effective at ambient temperatures of about 60°–130° F., and a pH range of from about 10–13.

It is believed that the additive of the present invention may also be used apart from the cleaner in order to provide improved protection and lubricity to clean metallic surfaces.

The treatment is prepared for use by blending its components together in an aqueous medium, such as deionized water, to form a concentrate. The treatment is equally effective in hard waters and waters having a minimum hardness of about 40 ppm (expressed as Ca). Below 40 ppm, foaming may become a problem affecting performance. The treatment is dissolved within the aqueous medium in a concentration of from about 1.5% v/v to about 5% v/v.

The parts being tested were spray cleaned. It is expected that the treatment will provide comparable performance in immersion applications.

A preferred formulation would contain potassium hydroxide, an alkali metal tripolyphosphate, monoethanolamine, an alkali metal silicate and an ethoxylated alkyl ether phosphate. The following weight ranges of particular components are anticipated to be effective: 1–10% potassium hydroxide, 2–10% tripolyphosphate, 5–20% monoethanolamine, 2–20% silicate and 1–10% ethoxylated alkyl ether phosphate with the remainder as water.

A particularly preferred formulation (experimental formulation) contains the following components:

| | Weight Percentages (Approximate) |
|---|---|
| Potassium Hydroxide Solution, 45% | 5% |
| Sodium Tripolyphosphate | 4% |
| Monoethanolamine | 10% |
| Sodium Silicate | 6% |
| Ethoxylated alkyl ether phosphate | 3% |
| Water | Remainder |

The present invention will be further illustrated, but is not limited by, the following examples.

Aluminum sleeve castings obtained from a commercial washer were used for friction tests. The sleeves were spray cleaned for 10 seconds with a 2% solution of the experimental formulation followed by an air blowoff. The cleaner temperature was varied from about 75° F. to 130° F. Coefficients of friction were obtained from experimentally measured data after 1 hour and after 7 days, and are listed in Table 1.

Coefficients of static friction were determined using an inclined plane. In this method, two sleeves are placed parallel to each other, against a stop that is parallel to the hinge of the plane. Positioning feet retain the sleeves in a parallel orientation about 0.5 cm apart at the sides, and they ensure reproducible placement. A third sleeve is placed parallel to, and resting on the other two. The edges are offset to overhang by about 1 cm so the edges are not in contact. The plane is inclined slowly. The angle at which the upper sleeve begins, and continues to slide along the lower sleeves is recorded. The sleeves are then interchanged, so that each sleeve is in each of the three possible positions for two trials. The six angles of incline are averaged. The coefficient of static friction is the largest of this angle.

TABLE I

| | Coefficient of Static Friction | |
|---|---|---|
| Temperature (°F.) | 1 hour | 7 days |
| 75 | 0.35 | 0.36 |

TABLE I-continued

| | Coefficient of Static Friction | |
|---|---|---|
| Temperature (°F.) | 1 hour | 7 days |
| 80 | 0.38 | 0.36 |
| 100 | 0.38 | 0.40 |
| 110 | 0.37 | 0.41 |
| 120 | 0.38 | 0.42 |
| 130 | 0.38 | 0.41 |

These results indicate that the cleaned pads exhibit satisfactory and stable coefficients of friction at all cleaning temperatures, from ambient to 130° F. The cleaned pads remained bright and unstained for the duration of the 7 day tests. There were no visible signs of oxide development.

Coefficients of friction of various commercial cleaners are high and increase more significantly over time, as shown in Table II. Test solutions were prepared in deionized water and sprayed at 70° F. at 20 psig through full jet nozzles.

TABLE II

| | Coefficient of Friction - Aluminum Panels | |
|---|---|---|
| | 1 hour | 5 days |
| 2% Meqqem ® 8515 (Castrol Industrial, Inc.) | 0.44 | 0.53 |
| 0.1% Amphoteric 400 (Exxon Corp.) | 0.57 | 0.70 |

(The Meqqem product is a proprietary combination containing non-ionic surfactants and sequestrants, while the Amphoteric product is an alkyl imino acid, monosodium salt.)

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

I claim:

1. A method for reducing and maintaining the coefficient of friction of a metal surface cleaned by an alkaline cleaner, while preventing foaming on said metal surface, which comprises contacting the clean metal surface with a treatment comprising monoethanolamine, an ethoxylated alkyl ether phosphate and a silicate, wherein the surface is contacted with the treatment at a temperature of from about 60° to 120° F. and a pH of from about 10–13.

2. The method as recited in claim 1 wherein said metal surface includes aluminum.

3. The method as recited in claim 1 wherein said treatment is dissolved in an aqueous medium in a concentration of from about 1.5% to about 5.0% by volume.

4. The method as recited in claim 1 wherein said ethoxylated alkyl ether phosphate is a polyoxyethylene octadecenyl ether phosphate.

5. The method as recited in claim 1 wherein said metal surface includes brass.

6. The method as recited in claim 1 wherein said metal surface includes copper.

7. The method as recited in claim 1 wherein said metal surface is ferrous-based.

8. A composition for reducing and maintaining the coefficient of friction of a metal surface cleaned by an alkaline cleaner, while preventing foaming on said metal surface, which comprises monoethanolamine, an ethoxylated alkyl ether phosphate and a silicate in an aqueous medium.

* * * * *